US005819519A

United States Patent [19]

Iwama

[11] Patent Number: 5,819,519

[45] Date of Patent: Oct. 13, 1998

[54] SPINNING RING

[75] Inventor: Yasushi Iwama, Aichi-ken, Japan

[73] Assignee: Nippo Ltd., Japan

[21] Appl. No.: 920,615

[22] Filed: Aug. 27, 1997

Related U.S. Application Data

[62] Division of Ser. No. 646,296, filed as PCT/JP95/01852 Sep. 18, 1995.

[30] Foreign Application Priority Data

| | | | |
|---|---|---|---|
| Sep. 16, 1994 | [JP] | Japan | 6-221689 |
| Sep. 16, 1994 | [JP] | Japan | 6-221690 |
| Feb. 3, 1995 | [JP] | Japan | 7-16606 |
| Feb. 17, 1995 | [JP] | Japan | 7-29258 |
| Mar. 8, 1995 | [JP] | Japan | 7-48223 |
| Jul. 12, 1995 | [JP] | Japan | 7-176238 |

[51] Int. Cl.[6] ..... D01H 7/64

[52] U.S. Cl. ..... 57/124; 57/75; 57/137

[58] Field of Search ..... 57/75, 119, 124, 57/121, 137

[56] References Cited

U.S. PATENT DOCUMENTS

| | | | |
|---|---|---|---|
| 3,494,120 | 2/1970 | Chipan et al. | 57/75 |
| 3,785,140 | 1/1974 | Muller | 57/75 |
| 4,051,657 | 10/1977 | Spies | 57/124 |
| 4,095,402 | 6/1978 | Yamaguchi | 57/124 |
| 4,114,359 | 9/1978 | Creus | 57/75 |
| 4,238,920 | 12/1980 | Le Chatelier | 57/124 |
| 4,305,246 | 12/1981 | Donmez et al. | 57/124 |
| 4,769,689 | 9/1988 | Arce | 57/124 |
| 5,009,063 | 4/1991 | Yamaguchi et al. | 57/75 |
| 5,148,662 | 9/1992 | Yamaguchi | 57/124 |

FOREIGN PATENT DOCUMENTS

| | | | |
|---|---|---|---|
| 114580 | 8/1984 | European Pat. Off. . | |
| 826716 | 11/1952 | Germany . | |
| 5860028 | 4/1983 | Japan . | |
| 7042056 | 9/1987 | Japan | 57/124 |

*Primary Examiner*—William Stryjewski
*Attorney, Agent, or Firm*—Conley, Rose & Tayon, P.C.

[57] ABSTRACT

The present invention is for spinning ring for winding a yarn fed from a raw yarn bobbin on a bobbin including a stationary ring that is mounted on a ring rail. A rotary ring is disposed inside and concentrically with the stationary ring for rotation about the central axis thereof. The bobbin is disposed inside and concentrically with the rotary ring for rotation about the central axis thereof. A traveler is disposed on the rotary ring for revolution in the circumferential direction of the rotary ring to guide the yarn fed from the supply bobbin with respect to the bobbin. When the bobbin is rotated substantially at normal operating speed, the speed of the traveler and the rotary ring are rotated substantially in unison with each other relative to the stationary ring.

4 Claims, 16 Drawing Sheets

SPINNING RING

This is a divisional application of copending U.S. application Ser. No. 08/646,296, filed as PCT/JP95/01852 Sep. 18, 1995.

FIELD OF THE INVENTION

This invention relates to spinning rings for winding yarns fed from yarn feeders on bobbins.

BACKGROUND OF THE INVENTION

Among prior art spinning rings of the pertaining type is one which comprises a stationary ring, a rotary ring and a traveler.

The stationary ring is secured to a base member.

The rotary ring is disposed inside and concentrically with the stationary ring for rotation about the central axis thereof. The bobbin is disposed inside and concentrically with the rotary ring for rotation about the central axis thereof.

The traveler is provided on the rotary ring for revolution in the circumferential direction of the rotary ring to guide the yarn fed from the yarn feeder to the bobbin.

With the rotation of this bobbin, the traveler undergoes revolution along the edge of outer periphery of the rotary ring in the circumferential direction thereof, so that the yarn fed from the yarn feeder is taken up on the bobbin while being twisted. When the traveler is caused to undergo revolution, the rotary ring is caused to be rotated.

The yarn (raw yarn) fed from the yarn feeder is thus spun and taken up on the bobbin.

The higher the rotation speed of the bobbin, the better the spinning efficiency.

The rotation of the bobbin and the revolution of the traveler correspond to each other, and also the revolution of the traveler and the rotation of the rotary ring are related to each other.

It is, accordingly, an object of the invention to improve the spinning efficiency by improving the revolution of the traveler and the revolution of the rotary ring.

DISCLOSURE OF THE INVENTION

The invention features, in its first aspect, a spinning ring for winding a yarn fed from a yarn feeder on a bobbin, which comprises a stationary ring mounted on a base member, a rotary ring disposed inside and concentrically with the stationary ring for rotation about the central axis thereof, the bobbin being-disposed inside and concentrically with the rotary ring for rotation about the central axis thereof, and a traveler disposed on the rotary ring for revolution in the circumferential direction of the rotary ring to guide the yarn fed from the yarn feeder with respect to the bobbin, wherein when the bobbin is rotated substantially at normal operating speed, the speed of the traveler relative to the rotary ring is substantially zero, so that the traveler and the rotary ring are rotated substantially in unison with each other relative to the stationary ring.

When the bobbin starts to be rotated (i.e., accelerated), the traveler is caused to undergo revolution relative to the stationary ring, so that the rotary ring is caused to start rotation gradually relative to the rotary ring. When the bobbin reaches the normal operating speed (but not always right after the normal operating speed is reached), the rotary ring is rotated at a speed corresponding to the rotational speed of the bobbin to make substantially zero the speed of revolution of the traveler relative to the rotary ring. Consequently, the traveler and the rotary ring are rotated substantially in unison with each other relative to the stationary ring.

In this state, the traveler no longer receives substantial frictional force due to its rotation relative to the rotary ring. The burden (i.e., degree of damage) of the traveler is reduced, so that its life can be extended. In addition, the speed of rotation of the bobbin can be increased to obtain improved production efficiency.

The invention also features, in its second aspect, a spinning ring for winding a yarn fed from a yarn feeder on a bobbin, which comprises a stationary ring mounted on a base member, a rotary ring disposed inside and concentrically with the stationary ring for rotation about the central axis thereof, the bobbin being disposed inside and concentrically with the rotary ring for rotation about the central axis thereof, and a traveler disposed on the rotary ring for revolution in the circumferential direction of the rotary ring to guide the yarn fed from the yarn feeder with respect to the bobbin, the rotary ring having a brake section for applying a braking force to the rotary ring.

According to the invention, a braking force is applied to the rotary ring, the rotation of which is related to the revolution of the traveler. Consequently, a braking force is applied with respect to the revolution of the traveler.

When the bobbin is rotated at high speed so that the yarn undergoes high speed revolution in unison with the rotary ring and the traveler, the yarn is expanded side-wise by a great centrifugal force. If the phenomenon of side-wise expansion of ballooning is pronounced, the yarn may be in highly forced contact with an adjacent member or the like to be broken (ballooning collapse phenomenon).

According to the invention, owing to the braking force applied to the rotary ring and the traveler, the yarn is always pulled by a predetermined pulling force. The ballooning collapse is thus suppressed to prevent the yarn from being in contact with an adjacent member or the like and being broken.

In addition, when the rotary ring and the traveler are stopped after delay when the bobbin is stopped (over-run rotation), the yarn is disturbed in the neighborhood of the traveler (snarl phenomenon). According to the invention, such snarl phenomenon is prevented by the braking force acting on the rotary ring and the traveler.

The invention features, in its third aspect, the spinning ring in the second aspect of the invention, in which the brake section is a non-flat air brake section for applying to the rotary ring a braking force which is based on a frictional force produced between the brake section and the air around the rotary ring.

According to the invention, the frictional force between the air brake section and the neighboring air is increased with increasing rotational speed of the rotary ring, and the braking force is applied to the rotary ring in correspondence to the rotational speed of the rotary ring. It is thus possible to more effectively obtain the effect in the second aspect of the invention.

The invention further features, in its fourth aspect, the spinning ring in the third aspect of the invention, in which the air brake section comprises a plurality of blades extending in the radial direction of the rotary ring.

The invention still further features, in its fifth aspect, the spinning ring in the second aspect of the invention, in which the brake section comprises a plurality of brake elements capable of advancement and retreat in the radial direction of the rotary ring, the brake elements being advanced by centrifugal forces generated with the rotation of the rotary ring, the advanced brake elements being brought into contact with the stationary ring, According to the invention, centrifugal forces are applied to the brake elements in correspondence to the rotational speed of the rotary ring, and frictional forces are generated between the blade elements and the stationary ring when the brake elements are advanced and brought into contact with the stationary ring. A braking force is thus applied to the rotary ring in correspondence to the rotational speed of the rotary ring. Thus, as in the third aspect of the invention, it is possible to more effectively obtain the effect in the second aspect of the invention.

The invention yet further features, in its sixth aspect, the spinning ring in the first to fifth aspects of the invention, which further comprises a slide ring disposed between the stationary ring and the rotary ring and capable of being in sliding contact with both the stationary ring and the rotary ring.

The slide ring permits smoother rotation of the rotary ring relative to the stationary ring, and thus enables high speed rotation of the rotery ring.

The invention further features, in its seventh aspect, the spinning ring in the sixth aspect of the invention, in which the slide ring has a single cut section.

With the rotation of the rotary ring in unison with the traveler, the slide ring receives impact force in its radial direction. However, since the slide ring has a cut section, it can be elastically deformed to increase or reduce the clearance of the cut section. The slide ring thus can be elastically expanded or contracted just like a spring, so that it can absorb the impact force from the rotary ring with its elastic deformation to reduce the degree of re-transfer of the impact force from the rotary ring back to the same. Impact force thus is not transferred back to the rotary ring so much, and smooth high speed rotation of the rotary ring can be ensured.

The invention further features, in its eighth aspect, the spinning ring in the sixth aspect of the invention, in which the slide ring is divided into a plurality of ring portions.

As noted above, with the rotation of the rotary ring in unison with the traveler, the slide ring receives impact force in its radial direction. However, since the slide ring is divided into a plurality of ring portions, these ring portions can readily be moved finely in the radial direction then impact force is applied thereto in the radial direction with the rotation of the rotary ring. Thus, they can readily absorb the impact force with their fine movement, thus ensuring smooth rotation of the rotary ring.

The invention further features, in its ninth aspect, the spinning ring in the sixth aspect of the invention, in which the slide ring has a portion thinner than other remaining portions.

The thin portion can more readily undergo elastic deformation than other portions, so that it can absorb the impact force developed by the rotation of the rotary ring by a greater degree.

The invention further features, in its tenth aspect, the spinning ring in the sixth aspect of the invention, in which the slide ring comprises a main ring made of an elastic material and having a cut section and a reinforcement ring without any cut section and fitted on the main ring.

The slide ring is rotated with the rotation of the rotary ring. If the slide ring comprises the sole main ring with a cut section, it may be expanded by centrifugal force generated by its rotation to be in forced contact with the stationary ring. As a result, the frictional force (i.e., sliding resistance) between the stationary ring and the slide ring is increased, thus possibly preventing smooth rotation of the rotary ring.

According to the invention, owing to the reinforcement ring, the main ring is not expanded beyond a predetermined diameter, that is, the slide ring itself is not expanded beyond a predetermined diameter. Thus, it is possible to prevent forced contact of the slide ring with the stationary ring and ensure smooth rotation of the rotary ring.

The invention further features, in its eleventh aspect, the spinning ring in the tenth aspect of the invention, in which the main ring and the reinforcement ring have different vibration attenuation characteristics.

With the different vibration attenuation characteristics of the main ring and the reinforcement ring, vibrations of the rotary ring developed by the rotation thereof can be more effectively attenuated.

The invention further features, in its twelfth aspect, a spinning ring for winding a yarn fed from a yarn feeder on a bobbin, which comprises a stationary ring mounted on a base member, a rotary ring disposed inside and concentrically with the stationary ring for rotation about the central axis thereof, the bobbin being disposed inside and concentrically with the rotary ring for rotation about the central axis thereof, a traveler disposed on the rotary ring for revolution in the circumferential direction of the rotary ring to guide the yarn fed from the yarn feeder with respect to the bobbin, and a plurality of slide rings disposed between the stationary ring and the rotary ring at a predetermined interval in the central axial direction of the stationary ring and the rotary ring and capable of being in sliding contact with both the rings. The "plurality " in this case is typically "two".

With the revolution of the traveler generating tension in the yarn, the rotary ring tends to undergo fine precession. According to the invention, such precession is prevented by the plurality of slide rings provided at a predetermined interval in the central axial direction of the stationary ring and the rotary ring, and the rotary ring is rotated accurately about its central axis. Since the precession of the rotary ring is prevented, the traveler undergoes uniform revolution, that is, smooth high speed revolution of the traveler is ensured. In addition, without precession of the rotary ring, smooth rotation of the rotary ring is not disturbed by increasing friction (i.e., rotational resistance) between the rotary ring and the stationary ring, and smooth high speed rotation of the rotary ring can be ensured.

The invention further features, in its thirteenth aspect, the spinning ring in the sixth to twelfth aspects of the invention, in which the slide rings are made of elastic synthetic resin, elastomer or metal.

The invention further features, in its fourteenth aspect, the spinning ring in the first to thirteenth aspects of the invention, in which the stationary ring is mounted in the base member such that it is fitted in a mounting hole in the base member, at least a portion of the stationary ring that is in contact with the base member being made of a synthetic resin. It will be noted that the whole stationary ring may be made of a synthetic resin.

Since not only the traveler undergoes revolution but also the rotary ring is rotated relative to the stationary ring, high impact force is applied to the stationary ring, According to the invention, however, at least a portion of the stationary ring that is in contact with the base member is made of a synthetic resin. Thus, compared to the case of a stationary ring made of a metal, the impact force is alleviated between the stationary ring and the base member. Consequently, the degree in which the impact force is re-transferred from the base member to the rotary ring and other parts can be reduced to permit smooth take-up of the yarn on the bobbin.

In addition, the revolution of the traveler generating tension in the yarn, the rotary ring undergoes fine precession, and this motion causes fine precession (i.e., fine vibrations) of the stationary ring as well. Therefore, if the stationary ring is made of a metal, its portion in contact with the base member may separate coating of the base member (which is usually made of a metal and is provided with a coating on its surface) due to its fine vibrations. In such a case, the portion of the base member with the coating separated therefrom may be rusted to stain the yarn with the rust. According to the invention, this does not occur because at least a portion of the stationary ring that is in contact with the base member is made of a synthetic resin. Rusting of the base member thus is eliminated.

The invention further features, in its fifteenth aspect, the spinning ring in the first to fourteenth aspects of the invention, in which the rotary ring is a one-piece molding.

This permits increased accuracy of the rotary ring.

Various other features of the invention are conceivable, which are combinations of the above features.

BRIEF DESCRIPTION OF THE DRAWINGS

FIGS. 2 to 8 are views for describing the spinning ring 10 according to a first embodiment of the invention, in which FIG. 2 is an exploded perspective view showing spinning rings 10 and a ring rail 74 shown in FIG. 1; FIG. 3 is a sectional view showing the spinning ring 10 and its neighboring parts; FIG. 4 is a fragmentary sectional view, to an enlarged scale, showing the spinning ring 10; FIG. 5 is a perspective view of a brake ring 46 in FIG. 4, shown inverted upside down; FIG. 6 is a perspective view showing a slide ring 40 in the spinning ring 10 shown in FIG. 4; FIG. 7 is a view showing the spinning rings 10 and their neighboring parts in the apparatus shown in FIG. 1 in an operating state; and FIG. 8 is a view showing an advantage of the spinning ring 10 in comparison to FIG. 4.

FIGS. 9 to 15 are views for describing modifications of the slide ring 40 in the spinning ring 10 of the first embodiment, in which FIG. 9 is a fragmentary perspective view showing a slide ring 40A; FIG. 10 is a fragmentary perspective view showing a slide ring 40B; FIG. 11 is a fragmentary perspective view showing a slide ring 40C; FIG. 12 is a fragmentary sectional view showing a slide ring 40D; and FIG. 13 is a fragmentary perspective view showing a slide ring 40E.

FIG. 14 is a perspective view showing a brake ring 46A, shown inverted upside down, as a modification of the brake ring 46.

FIG. 15 is a fragmentary perspective view showing a brake ring 46B, shown inverted upside down, as a different modification of the brake ring 46.

FIGS. 16 to 18 are views for describing the spinning ring 110 according to a second embodiment of the invention, in which FIG. 16 is a fragmentary sectional view (corresponding to FIG. 4) showing the spinning ring 110; FIG. 17 is a perspective view showing a slide ring 140 in the spinning ring 110 shown in FIG. 16; FIG. 18 is a perspective view showing a brake ring 146 in the spinning ring 110 shown in FIG. 16.

FIGS. 20 to 28 are views for describing a modification of the spinning ring 110 of the second embodiment, in which FIG. 20 is a fragmentary sectional view showing part of a rotary ring 130A as a modification of a rotary ring 130 and its neighboring parts; FIG. 21 is a perspective view showing a brake element 148A in the rotary ring 130A shown in FIG. 20; FIG. 22 is a fragmentary perspective view showing a brake ring 146B as a modification of the brake ring 146; FIG. 23 is a perspective view showing a brake element 148B in the brake ring 146B shown in FIG. 22; FIG. 24 is a fragmentary perspective view showing a brake ring 146C as a different modification of the brake ring 146; FIG. 25 is a perspective view showing a brake element 148C in the brake ring 146C shown in FIG. 24; FIG. 26 is a fragmentary sectional view (corresponding to FIG. 16) showing a spinning ring 210 as a modification of the spinning ring 110; FIG. 27 is a perspective view showing a slide ring 240 in the spinning ring 210 shown in FIG. 26; and FIG. 28 is an exploded perspective view showing the slide ring 240 shown in FIG. 27.

BEST MODES OF EMBODYING THE INVENTION

First Embodiment

A spinning apparatus employing spinning rings 10 (110, 210, 310, 410) as an embodiment of the invention will first be described with reference to FIG. 1 and other figures.

Above the spinning apparatus (FIG. 1), a number of raw yarn bobbins (or yarn feeders) 70 are provided in a row extending in a direction at right angles to the plane of paper. Drafting devices 72 are disposed on the opposite sides of a substantially central part of the apparatus in the height direction thereof. On the opposite sides of a lower part of the apparatus, ring rails (or base members) 74 (see FIG. 2) extend in a direction at right angles of the plans of paper.

The ring rails 74 are vertically movable by a drive force of a motor (not shown) as they are guided by vertically extending guide rods 78.

Figure 1:
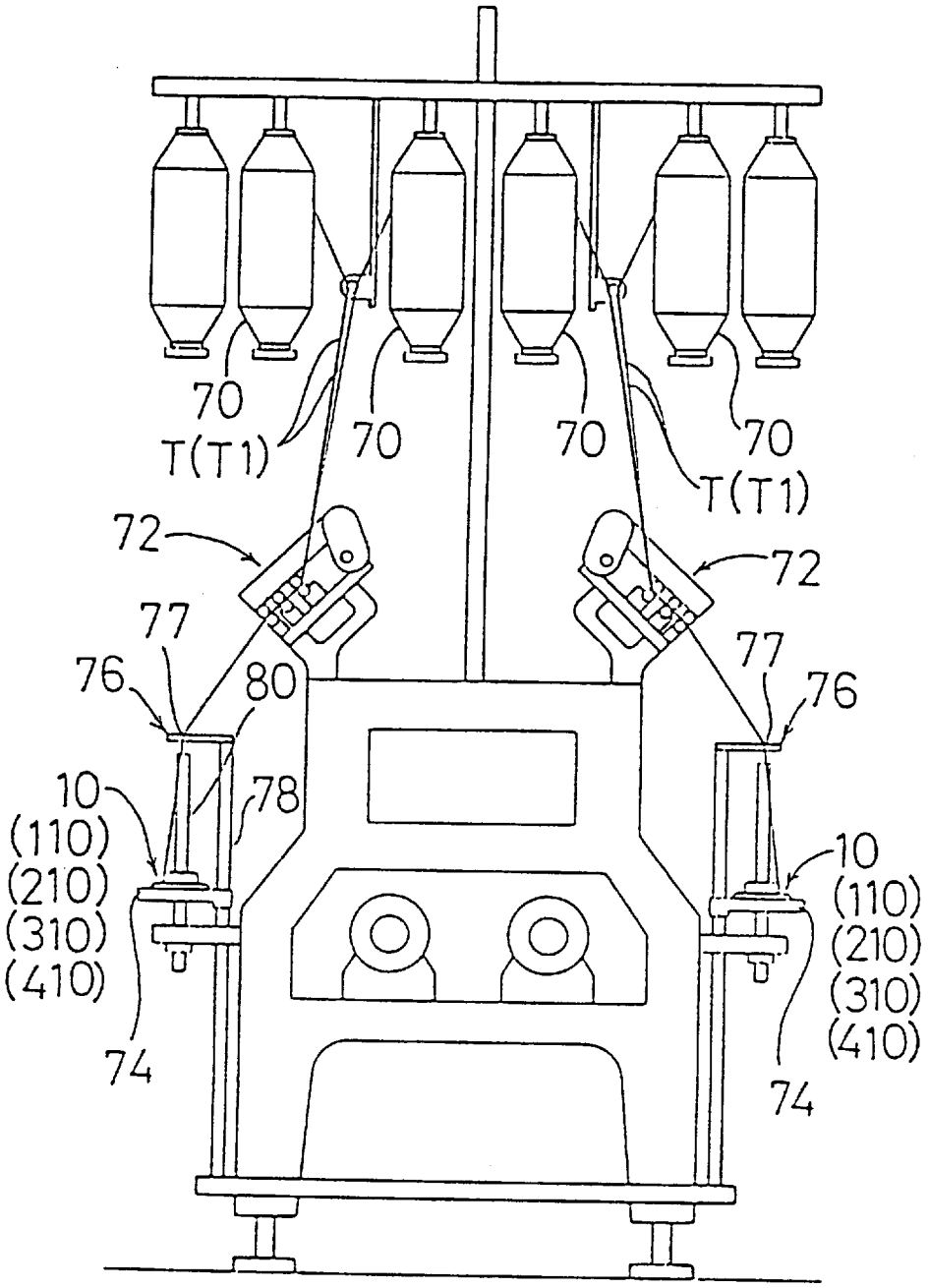
FIG. 1 is a view showing a spinning apparatus using spinning rings 10 (110, 210, 310, 410) as an embodiment of the invention.
Figure 2:
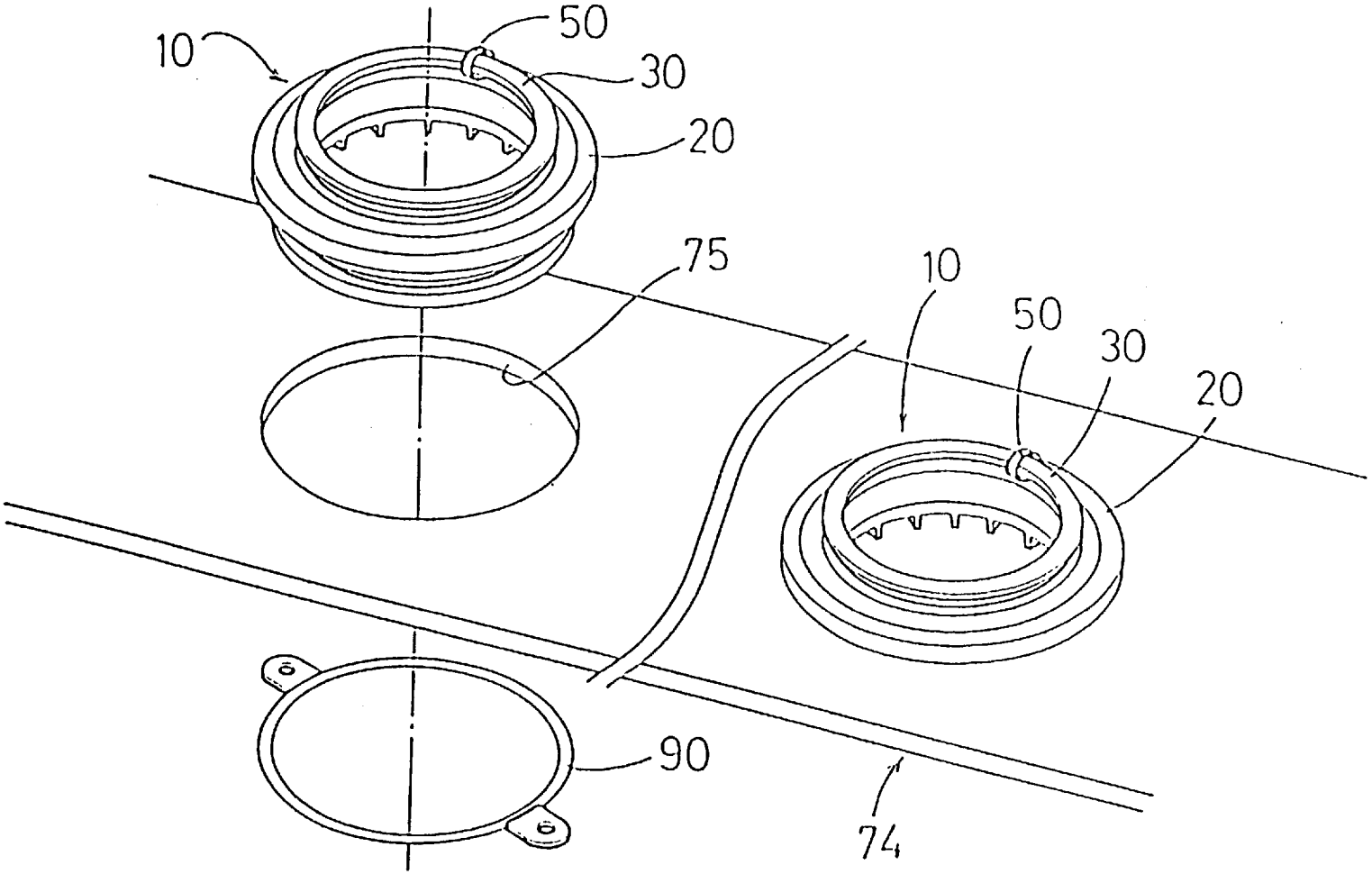
Figure 3:
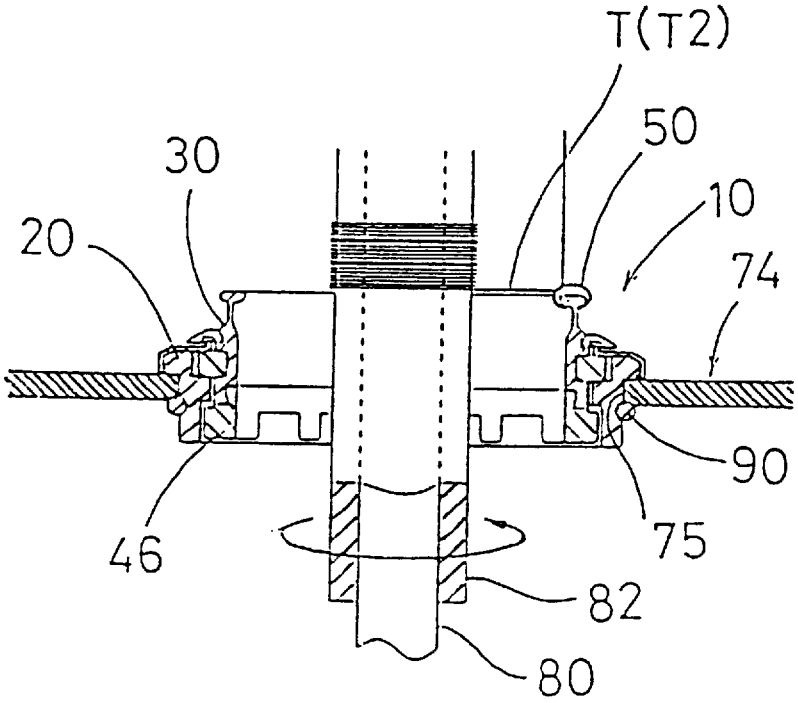

As shown in FIGS. 2 and 3, each ring rail (or base member) 74 has a number of mounting holes 75 arranged in a row extending in a direction at right angles to the plane of paper of FIG. 1. The spinning rings 10 (110, 210, 310, 410) are each fittedly mounted in each of the mounting holes 75.

The ring rails 74 are made of iron and have a coating provided on their surface.

Above the ring rails 74, guide members 76 are disposed such that they each face each spinning ring 10. Each guide member 76 has through holes 77 formed therein.

Figure 7:
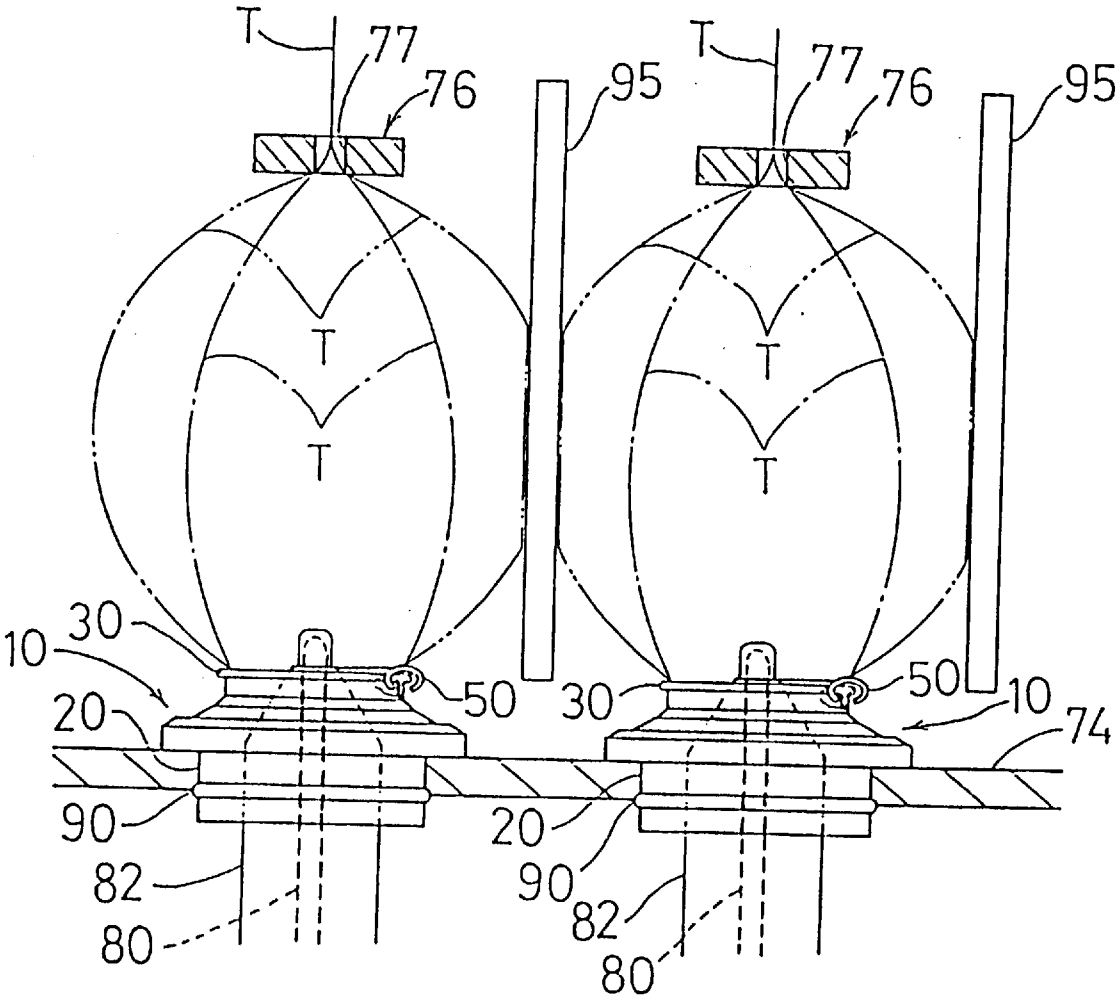

A separator (or partitioning member) 95 is provided between adjacent spinning rings 10 (see FIG. 7).

Figure 4:
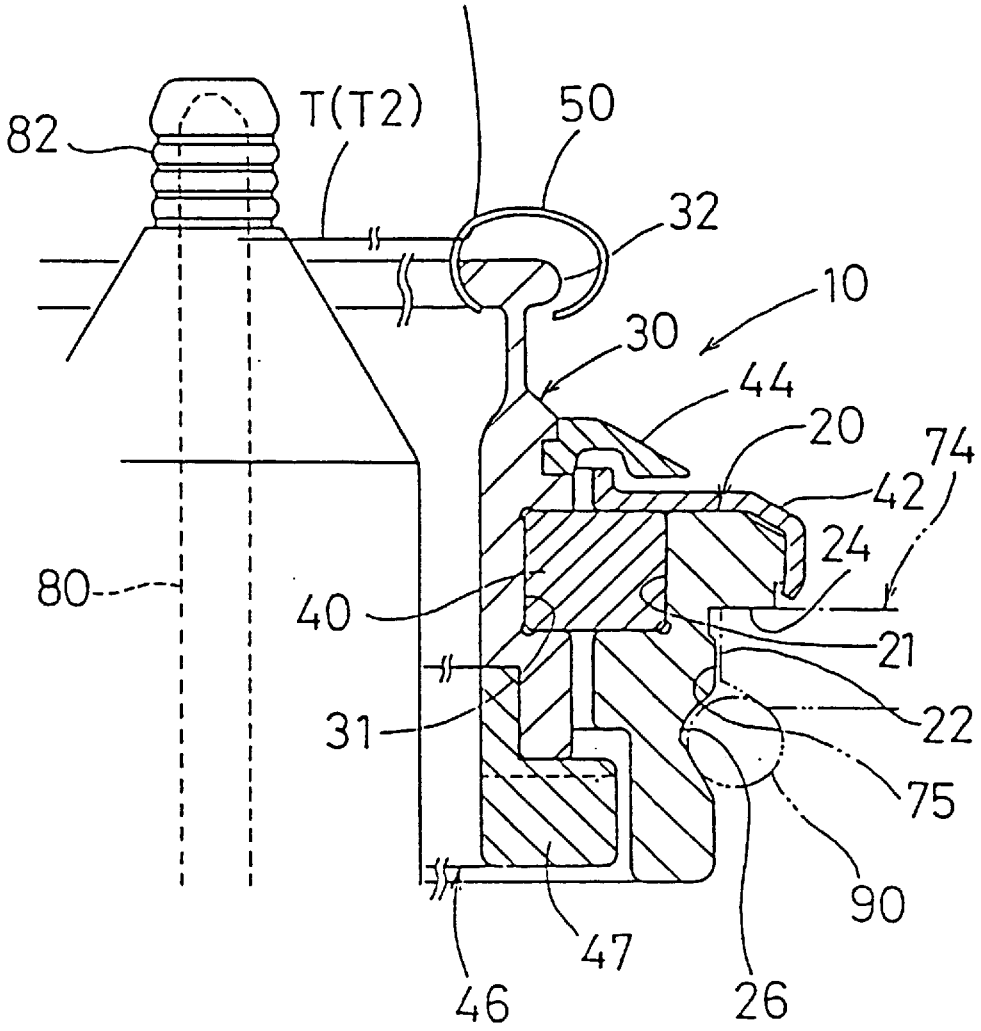

As shown in FIGS. 1, 3 and 4, a spindle 80 which is rotatable by a motor (not shown), extends along the axis of each spinning ring 10. A take-up bobbin (or spun yarn bobbin) 82 (not shown in FIG. 1) is fitted on the spindle 80 such that it is not rotatable relative thereto.

Yarn T (i.e., raw yarn T1) fed from each raw yarn bobbin 70 is led through each drafting device 72, the corresponding through hole 77 in each guide member 76 and a traveler 50 of etch spinning ring 10 to each bobbin 82. Yarn T (i.e., spun yarn T2) is taken up on the bobbin 82 with the rotation of the spindle 80 and the bobbin 82 while the associated ring rail 74 is moved vertically, The spinning ring 10 will now be described.

As shown in FIGS. 2 to 4, the spinning ring 10 comprises a stationary ring 20, a rotary ring 30 and the traveler 50.

The stationary ring 20 is made of a synthetic resin. As shown in FIG. 4, its outer peripheral part has a cylindrical mounting portion 22 and a ring-like mounting surface 24. The mounting portion 22 has a set ring receiving groove 26 formed in its lower portion. The inner peripheral part of the stationary ring 20 has a slide ring outer portion receiving recess 21 formed in its upper portion.

The rotary ring 30 is disposed inside and concentrically with the stationary ring 20 for rotation about the central axis thereof. The rotary ring 30 has a ring-like flange 32 formed at its top.

The outer peripheral part of the rotary ring 30 has a slide ring inner portion receiving recess 31. A slide ring 40 is provided between the stationary ring 20 (i.e., the slide ring outer portion receiving recess 21) and the rotary ring 30 (i.e., the slide ring inner portion receiving recess 31).

Figure 6:
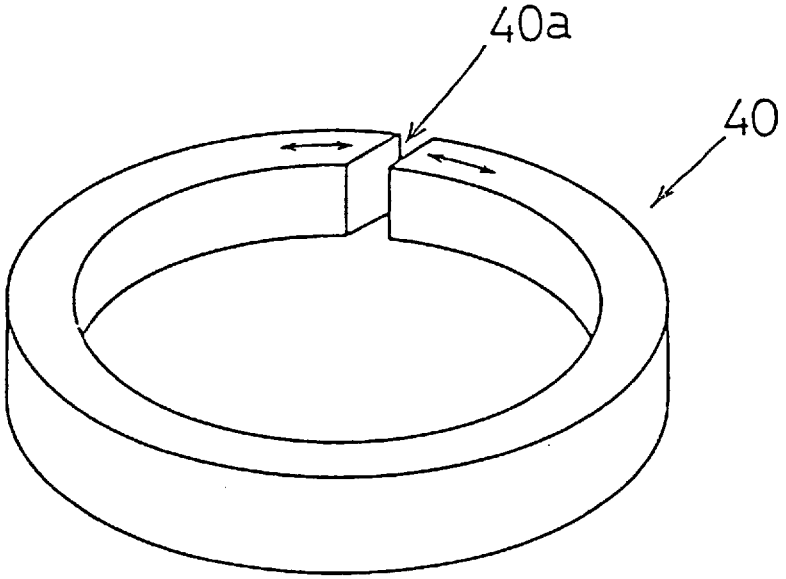

The slide ring 40 is made of an engineering plastic material elastomer or metal which is elastic, heat-resistant and wear-resistant and has a very small coefficient of friction. As shown in FIG. 6, the slide ring 40 has a rectangular sectional profile, and it has a cut section 40*a*. The slide ring 40 offers low frictional resistance to and slidable relative to both the stationery ring 20 and the rotary ring 30. The rotary ring 30 is assembled with the stationary ring 20 via the slide ring 40, and it is not in direct contact with the stationary ring 20. The rotary ring 30 is thus smoothly rotatable relative to the stationary ring 20.

Turning to FIG. 4, a liner cover 42 is fittedly secured to the stationary ring 20 to retain the slide ring 40 against detachment.

A dust-proof cover 44 is mounted on a somewhat upper portion of the rotary ring 30 to prevent dust from entering through the clearance between the stationary ring 20 and the rotary ring 30.

Figure 5:
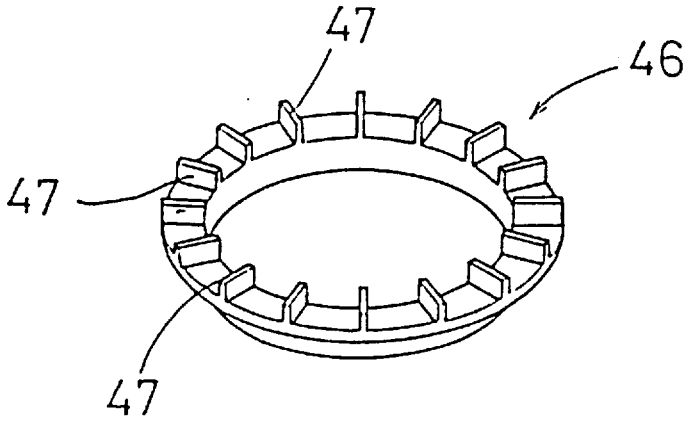

A brake ring 46 is mounted on the bottom of the rotary ring 30. The brake ring 46 is made of an engineering plastic material such as nylon resins. As shown in FIG. 5, the brake ring 46 has a number of blades which constitute an air brake section. The blades 47 extend in the radial direction of the brake ring 46 (i.e., in the radial direction of the rotary ring 30). The brake ring 46 (i.e., the blades 47) thus can provide air braking force to the rotary ring 30 in correspondence to the rotational speed of the rotary ring 30.

As shown in FIG. 4, the traveler 50 substantially has a shape of letter C turned down by 90 degrees, and it is fitted on the flange 32 of the rotary ring 30 for revolution relative to the flange 32 in the circumferential direction thereof.

As shown in FIGS. 2 and 4, the spinning ring 10 is mounted in the ring rail 74 with the mounting portion 22 of the stationary ring 20 fitted in the mounting hole 75 of the ring rail 74 such that the mounting surface 24 rests on a base surface portion adjacent the mounting hole 75 and with a rubber set ring 90 fitted in a set ring receiving groove 26.

As described above, the spindle 80 and the bobbin 82 extend through the rotary ring 30 (i.e., the central axis portion thereof).

The relationship among the stationery ring 20, the rotary ring 30 and the traveler 50 of the spinning ring 10 is as follows. When the bobbin 82 reaches the normal operating speed at 10,000 to 15,000 rotations/min. (but not always after the normal operating speed is reached), the rotary ring 30 is rotated such that the speed or revolution of the traveler 50 relative to the rotary ring 30 is made substantially zero, so that the traveler 50 and the rotary ring 30 are rotated substantially in unison with each other (i.e., substantially at the same speed) relative to the stationary ring 20.

In other words, the resultant of the frictional resistance of the rotary ring 30 developed to the slide ring 40 and the rotational resistance produced by air around the brake ring 46 and developed to the rotation of the rotary ring 30, is set such that the traveler 50 and the rotary ring 30 are rotated substantially at the same speed relative to the stationary ring 20.

The functions and effects of the spinning ring 10 will now be described.

As described before, as shown in FIGS. 1, 3 and 4, with the rotation of the spindle 80 and the bobbin 82, the yarn T (i.e., the raw yarn T1) fed from the raw yarn bobbin (yarn feeder) 70 is drafted by the drafting device 72 and is guided through the through hole 77 of the guide member 76 and the traveler 50 of the spinning ring 10 to be taken up on the bobbin 82 while being twisted.

With the start of rotation of the bobbin 82, the traveler 50 starts to undergo revolution, and the rotary ring 30 is caused to be rotated relative to the stationary ring 20 by the frictional resistance between the traveler 50 and the rotary ring 30. As a result, the revolution (i.e., absolute speed) of the traveler 50 relative to the stationary ring 20 is distributed into the rotation of the rotary ring 30 relative to the stationary ring 20 and the revolution (i.e., relative speed) of the traveler 50 relative to the rotary ring 30. This means that high speed rotation of the bobbin 82 does not bring about a corresponding high speed of revolution of the traveler 50 relative to the rotary ring 30. Thus, it is possible to improve the production efficiency by increasing the rotational speed of the bobbin 82.

When the bobbin 82 reaches the high speed and normal operating speed at 10,000 to 15,000 rotations/min., the speed of the traveler 50 relative to the rotary ring 30 is substantially zero, that is, the traveler 50 and the rotary ring 30 are rotated substantially in unison with each other (or substantially at the sane speed) relative to the stationary ring 20. The traveler 50 thus does not receive much frictional force produced between the traveler 50 and the rotary ring 30. The burden (or degree of damage) of the traveler 50 is reduced, so that its life can be extended.

At the time of the start of rotation (i.e., acceleration) of the traveler 50, the rotary ring 30 may not be rotated at the same speed as the traveler 50. However, when the revolution of the traveler 50 reaches substantially the normal operating speed, the rotary ring 30 is rotated substantially at the same speed as the traveler 50.

The slide ring 40 that is interposed between the stationary ring 20 and the rotary ring 30, permits smoother rotation of the rotary ring 30 compared to the case where the rotary ring 30 is in direct sliding contact with the stationary ring 20.

With the rotation of the rotary ring 30 in unison with the traveler 50, the slide ring 40 receives impact force in its radial direction. However, since the slide ring 40 has a cut section 40*a*, it can be elastically deformed to increase or reduce the clearance of the cut section 40*a*. The slide ring 40 thus can be elastically expanded or contracted just like a spring, so that it can absorb the impact force from the rotary ring 30 with its elastic deformation to reduce the degree of re-transfer of the impact force from the rotary ring 30 back to the same. Impact force thus is not transferred back to the rotary ring 30 so much, and smooth high speed rotation of the rotary ring 30 can be ensured.

Figure 8:
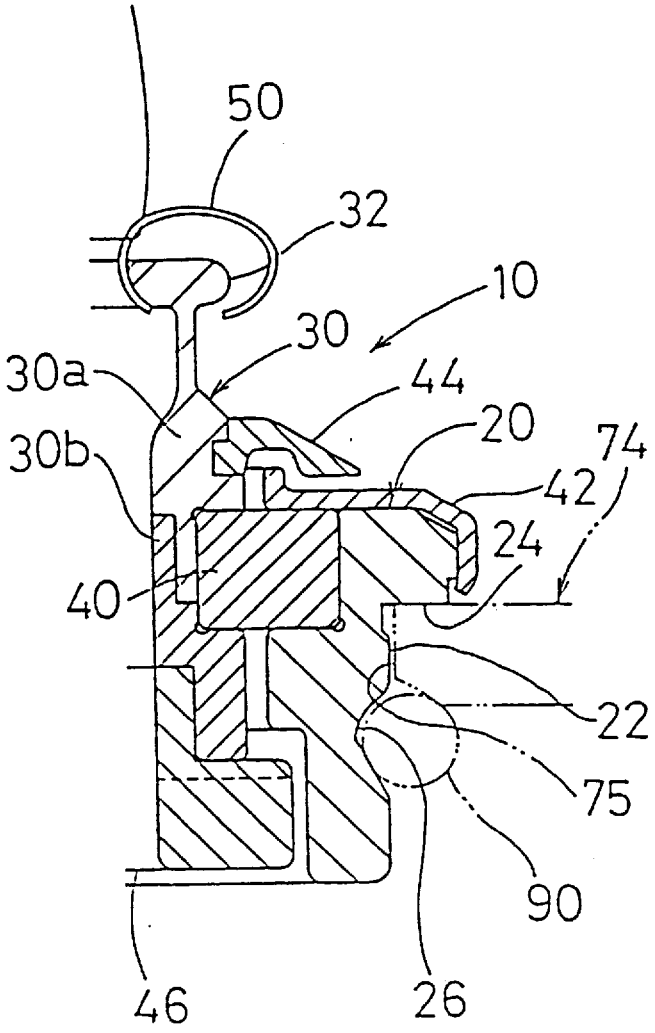

The cut section 40*a* of the slide ring 40 has the following advantage. In the manufacture of the spinning ring 10, the slide ring 40 can be readily fitted on the one-piece rotary ring 30 (i.e., in the slide ring inner portion receiving recess 31 thereof) by elastically deforming it such as to expand the clearance of the cut section 40*a*. With a slide ring 40 which does not have any cut section 40*a*, the rotary ring 30 has to be produced as a first portion 30*a* and a second portion 30*b*, as shown in FIG. 8, In this case, the slide ring 40 is assembled by separating the first portion 30*a* and the second portion 30*b* from each other, and afterwards the first portion 30*a* and the second portion 30*b* are coupled together. With this construction, however, the accuracy of the rotary ring 30 is sacrificed to result in deterioration of the performance of the spinning ring 10. The present spinning ring 10 is free from such disadvantage because the slide ring 40 has the cut section 40*a*.

As described above, when the bobbin 82 is rotating at high speed, the traveler 50 is also undergoing revolution at high speed. The broke ring 46 thus applies a strong braking force to the rotary ring 30. Besides, since the traveler 50 is undergoing revolution substantially at the same high speed as the rotary ring 30, a strong centrifugal force is exerted to the traveler 50, which is thus undergoing revolution in unison with the rotary ring 30. Consequently, a strong braking force is exerted to the traveler 50 by the brake ring 46.

When the bobbin 82 is rotated at high speed so that the yarn T undergoes revolution at high speed in unison with the traveler 50 and the rotary ring 30, the yarn T experiences a great centrifugal force and is expanded between the through hole 77 of the guide member 76 and the traveler 50, as shown in FIG. 7. When the yarn T is strongly brought into contact with a separator 95 as shown by broken lines in FIG. 7, it may be broken by the contact resistance.

In the present spinning ring 10, however, owing to the braking force applied to the rotary ring 30 and the traveler 50 as noted above, the yarn T is always pulled by a predetermined pulling force. This has an effect of suppressing the ballooning to be small as shown by broken lines in FIG. 7. Thus, excessively forced contact of the yarn T with the separator 95 is prevented to prevent breakage of the yarn T, so that smooth spinning operation can be ensured.

When the rotary ring 30 and the traveler 50 are stopped after delay when the spindle 80 and the bobbin 82 are stopped (over-run rotation), the yarn T is disturbed in the neighborhood of the traveler 50 (snarl phenomenon). In the present spinning ring 10, such snarl phenomenon can be prevented by the braking force acting on the rotary ring 30 and the traveler 50 as described above.

Further, as described above, the slide ring 40 is interposed between the stationary ring 20 and the rotary ring 30 such as to minimize the rotational resistance of the rotary ring 30. In the manufacture of a large number of spinning rings 10, fluctuations of the rotational resistance developed to the rotary ring 30 are inevitable. Minimization of the rotational resistance developed to the rotary ring 30 results in that the rotational resistance fluctuations can fall within a very fine range.

Thus, in the present spinning ring 10, with the rotational resistance developed to the rotary ring 30 minimized to make the rotational resistance fluctuations to be very fine, the rotary ring 30 is given a braking force by the brake ring 46. It is thus readily possible to set the resultant of the rotational resistance with respect to the brake ring 46 and other rotational resistance such that the traveler 50 and the rotary ring 30 are rotated substantially at the same speed relative to the stationary ring 20 when the bobbin 82 reaches the high speed and normal operating speed.

Since not only the traveler 50 is under revolution but also the rotary ring 30 is in rotation, great impact force is exerted to the rotating stationary ring 20. In the present spinning ring 10, however, the stationary ring 20 is made of a synthetic resin. Thus, the impact force received by the stationery ring 20 from the rotary ring 30 is not directly transmitted to the ring rail 74 but is transmitted after considerable attenuation, and the degree of re-transmission of impact force back to the rotary ring 30 is reduced. Thus, the yarn T (i.e., the spun yarn T2) can be smoothly taken up on the bobbin 82.

The revolution of the traveler 50 generating tension in the yarn T (i.e., the spun yarn T2) causes fine precession of the rotary ring 30, thus causing fine precession of the stationary ring 20 relative to the base member. If the stationary ring 20 is entirely made of metal, therefore, its mounting surface 24 (particularly the outer edge thereof) separates the coating of the ring rail 74, thus resulting in rusting of the ring rail portion deprived of the coating. In the present spinning ring 10, the stationary ring 20 is made of a synthetic resin so that impacts exerted to the ring rail 74 are gentle. It is thus possible to prevent separation of the coating from the ring rail 74 and resultant rusting thereof.

Modifications of First Embodiment

Modifications of the first embodiment will now be described.

FIGS. 9 to 13 show slide rings 40A, 40B, 40C, 40D and 40E as modifications of the slide ring 40.

Figure 9:
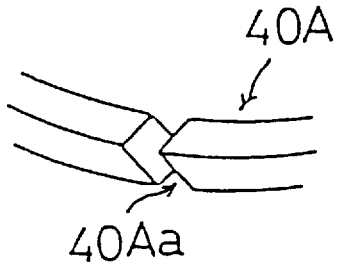
Figure 10:
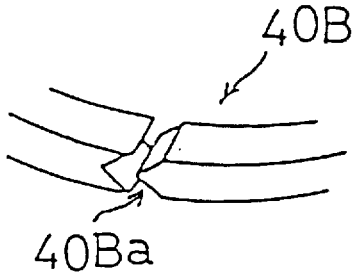
Figure 11:
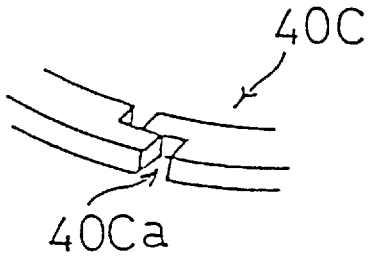

The slide ring 40A shown in FIG. 9 has a slanted cut section 40A*a*. The slide ring 40B shown in FIG. 10 has a V-shaped cut section 40B*a*. The slide ring 40C shown in FIG. 11 has a cut section 40C*a* having a staggered shape.

Figure 12:
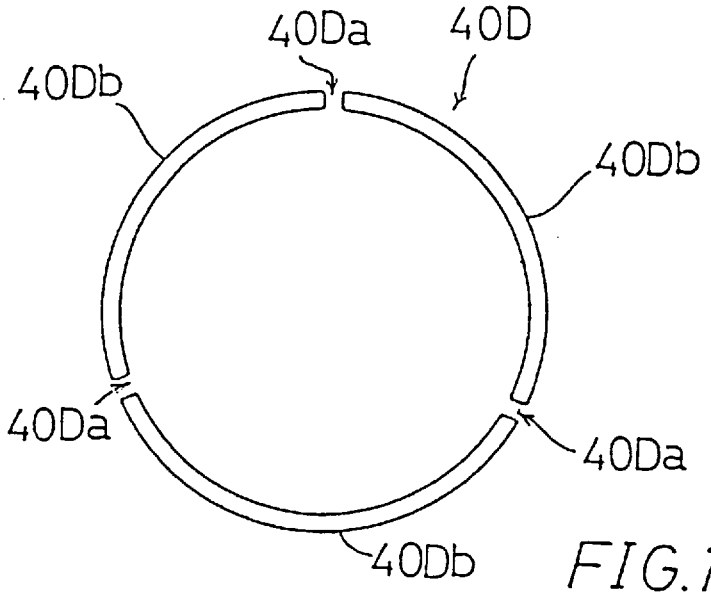

The slide ring 40D shown in FIG. 12 has three cut sections 40D*a*. That is, the slide ring 400 is divided into three distinct ring portions 40D*b*. Thus, it can be more readily fitted on the rotary ring 30 (i.e., in the slide ring inner portion receiving recess 31). In addition, because the slide ring 40D is divided into three ring portions 40D*b*, fine movements thereof in the radial direction may be readily caused by impact forces exerted to these ring portions 40D*b* in the radial direction. With such fine movements, the impact force from the rotary ring 30 can be readily absorbed. Besides, smooth rotation of the rotary ring 30 can be ensured. The slide ring 40D may be divided into any other number of ring portions than three.

Figure 13:
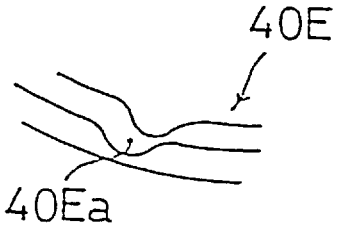

The slide ring 40E shown in FIG. 13 has not a cut section, but it has one or more thin portions 40E*a*. The thin portion or portions 40E*a* can be nore readily elastically deformed then other portions and thus can absorb more impact force generated with the rotation of this rotary ring 30.

The illustrated sectional shape of the slide ring 40E is by no means limitative, and it is possible as well to adopt various other sectional profiles, such as rectangular, circular and oval ones.

Figure 14:
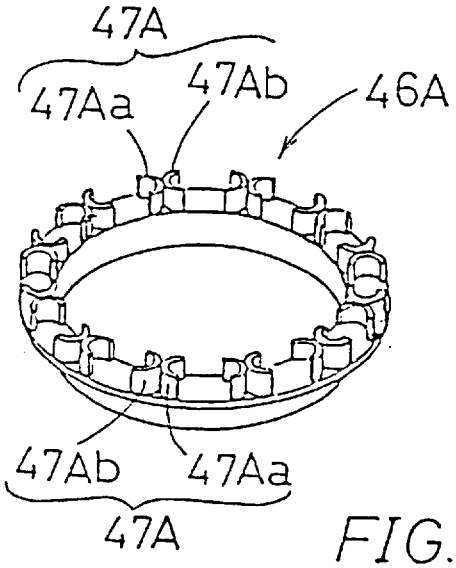
Figure 15:
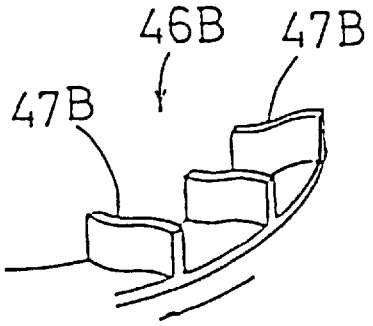

FIGS. 14 and 15 show brake rings 46A and 46B as modifications of the brake ring 46.

The brake ring 46A shown in FIG. 14 has a plurality of circumferentially spaced-apart blade sections 47A each having a pair of semi-cylindrical blades 47A*a* and 47A*b* in back-to-back arrangement.

The brake ring 48B shown in FIG. 15 has a plurality of blades 47B which are wavy in bottom view.

Second Embodiment

A spinning ring 110 according to a second embodiment of the invention will now be described with reference to FIGS.

16 to 19. The differences of this embodiment from the spinning ring 10 of the first embodiment will be mainly described.

Figure 16:
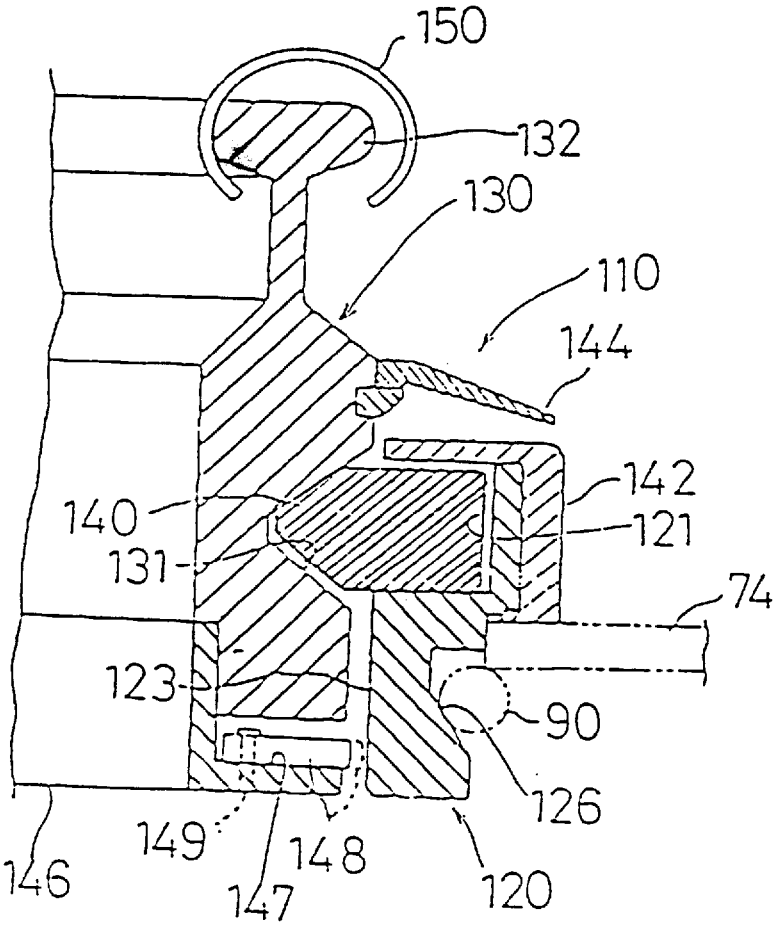

As shown in FIG. 16, this spinning ring 110 again comprises a stationary ring 120, a rotary ring 130 and a traveler 150.

The traveler 150 is mounted on a flange portion 132 of the rotary ring 130 for revolution in the circumferential direction of the flange portion 132.

Figure 17:
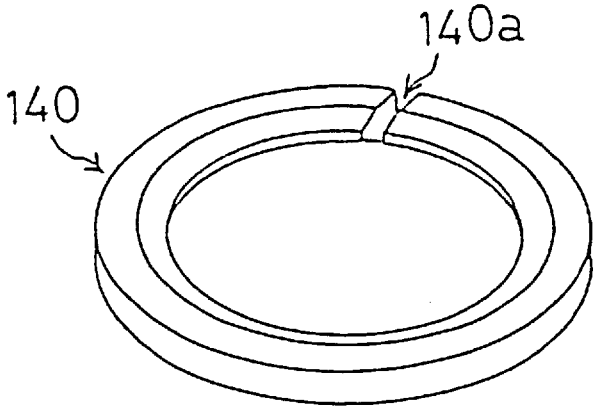

A slide ring 140 is interposed between the stationary ring 120 (i.e., a slide ring outer portion receiving recess 121) and the rotary ring 130 (i.e., a slide ring inner portion receiving recess 131). The slide ring 140 has a pentagonal (accurately hexagonal) section as shown and, as shown in FIG. 17, has a cut section 140*a*.

Turning to FIG. 15, a liner cover 142 is fixedly secured to the stationary ring 120, and a dust-proof cover 144 is mounted on the rotary ring 130.

Figure 18:
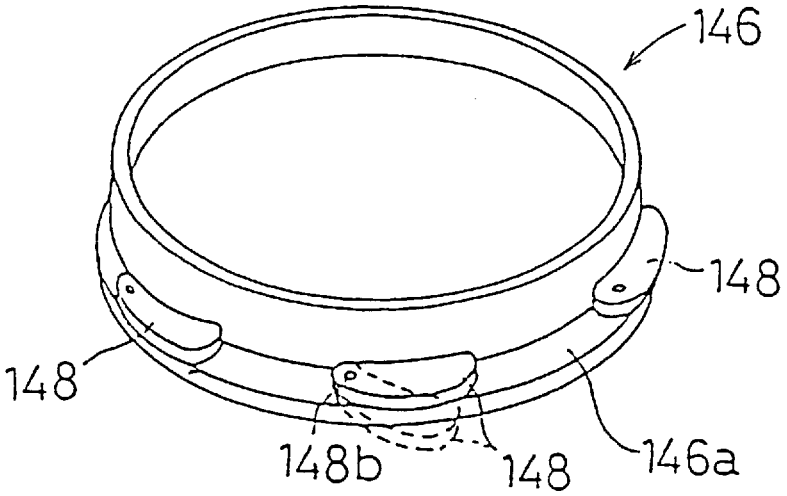
Figure 19:
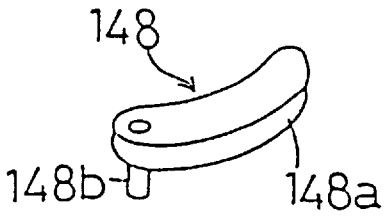
FIG. 19 is a perspective view showing a brake element 148 in the brake ring 146 shown in FIG. 18.

A brake ring 146 is secured to a bottom portion of the rotary ring 130. As shown in FIGS. 16 and 18, the brake ring 146 has a lower flange portion 146*a*, and a plurality of brake elements 148 (FIG. 19) are rotatably mounted by pins 148*b* on the flange portion 146*a*. The brake elements 148 can be advanced and retreated in the radial direction of the rotary ring 130. Each brake element 148 has a contact portion 148*a* as an end portion opposite the pin 148*b*. The brake element 148 is advanced by a centrifugal force generated with the rotation of the rotary ring 130.

In its retreated state (as shown by solid lines in FIG. 18), the contact portion 148*a* of each brake element 148 is not in contact with the inner peripheral surface 123 of the stationary ring 120. When the rotary ring 130 is rotated to advance the brake elements 148 (as shown by broken line in FIG. 18), the contact portion 148*a* of each brake element 148 is brought into contact with the inner surface 122 of the stationary ring 120.

The present spinning ring 110 will now be described mainly in connection with its peculiar functions and effects.

With the start of rotation of the bobbin 82, the traveler 150 starts revolution, and frictional resistance between the traveler 150 and the rotary ring 130 causes rotation of the rotary ring 130 relative to the stationary rising 120. When the bobbin 82 reaches its high speed and normal operating speed, the traveler 150 and the rotary ring 130 are rotated substantially at the same speed and substantially in unison with each other relative to the stationary ring 120.

With the rotation of the rotary ring 130 and according to the rotational speed thereof (to be exact, in proportion to the square of the rotational speed), a centrifugal force is applied to each brake element 148 of the brake ring 146, and this centrifugal force causes each brake element 148 to be advanced (each brake element 148 reaching the advanced state shown by broken line in FIG. 18). Thus, the contact portion 148*a* of each brake element 148 is brought into contact with the inner surface 123 of the stationary ring 120. As a result, a frictional force is generated between the brake ring 146 (i.e., each brake element 148) and the stationary ring 120, and the rotary ring 130 receives a braking force corresponding to its rotational speed. This braking force causes a braking force to be applied to the traveler 150 in unison with the rotary ring 130. Thus, the ballooning of the yarn T is suppressed to be small to prevent breakage of the yarn.

Modifications of Second Embodiment

Modifications of the second embodiment will now be described with reference to FIGS. 20 to 28.

Figure 20:
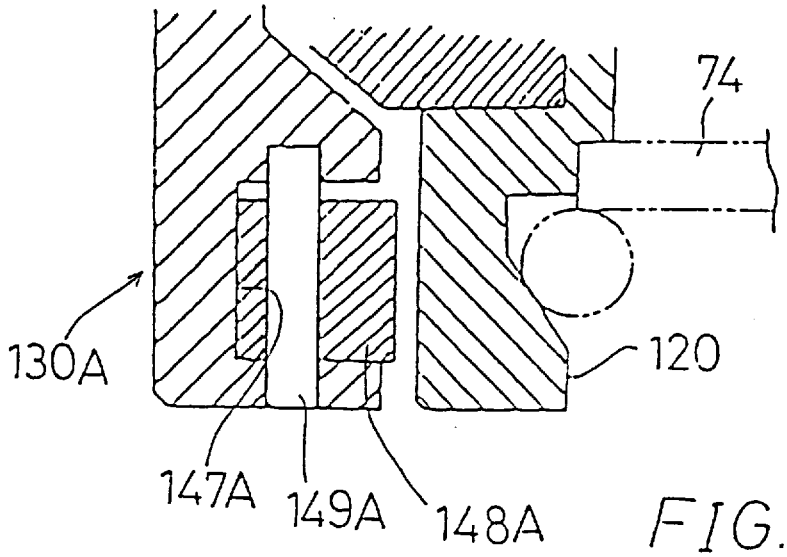
Figure 21:
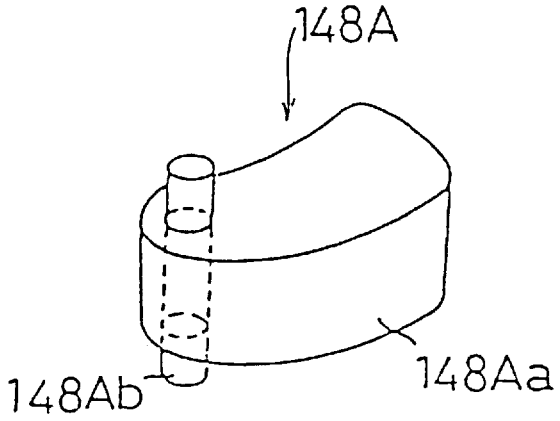
Figure 22:
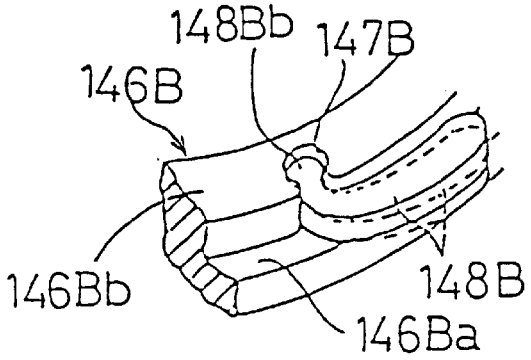
Figure 23:
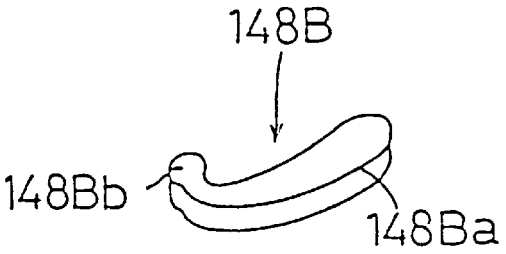
Figure 24:
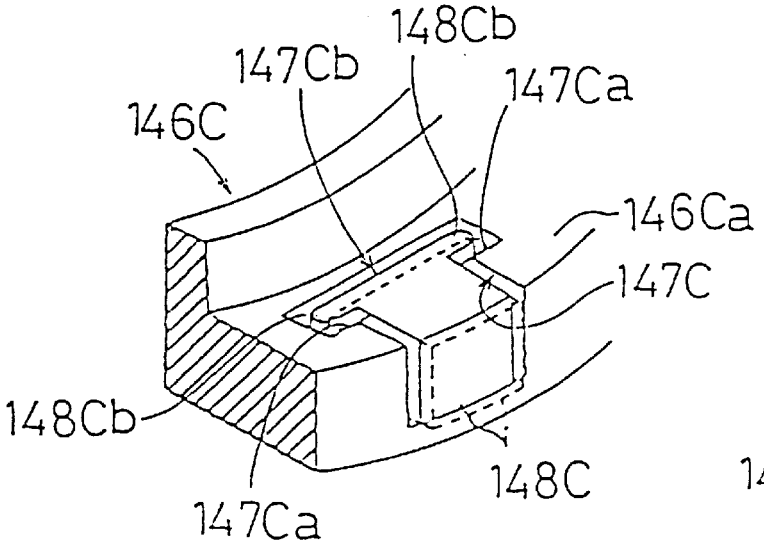
Figure 25:
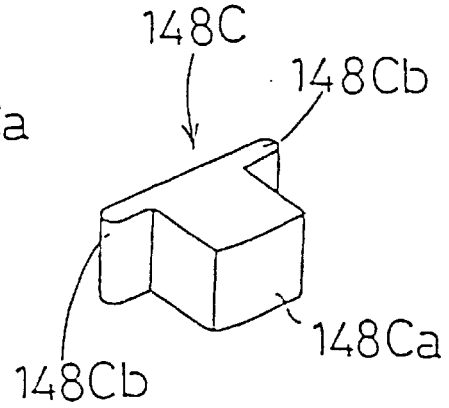
Figure 26:
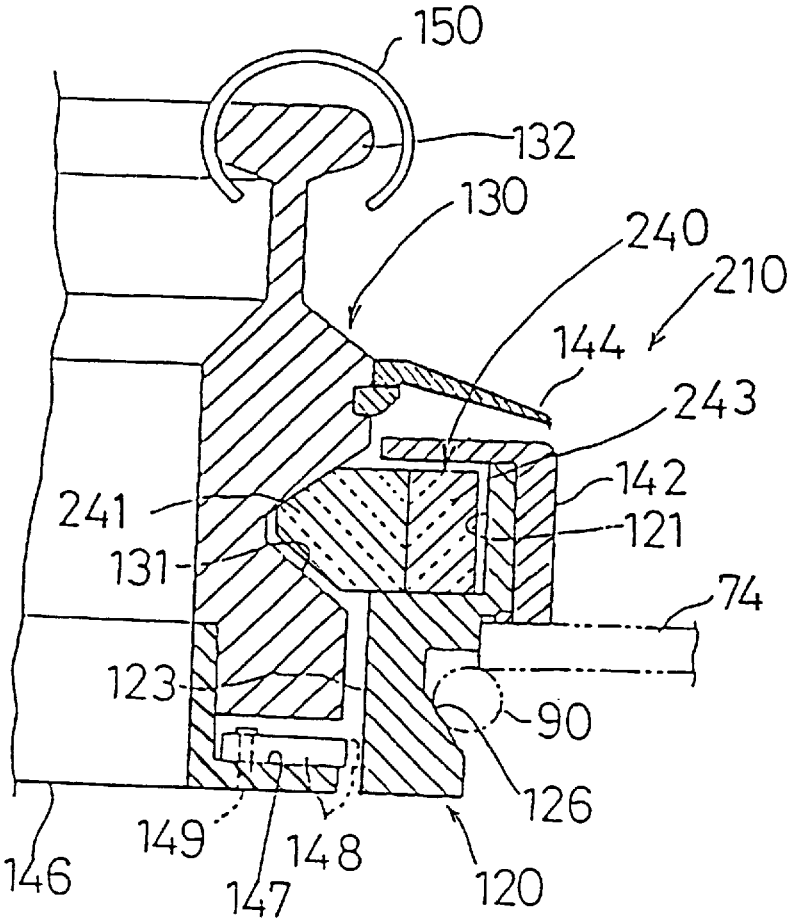
Figure 27:
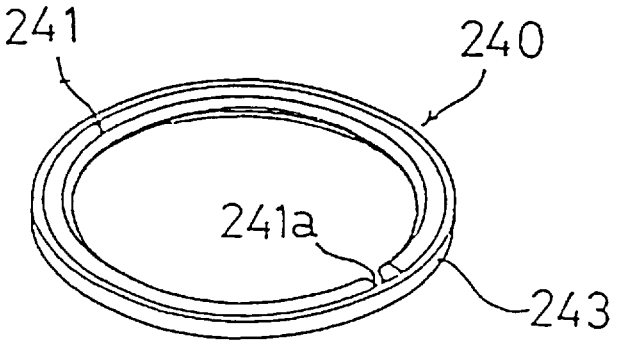
Figure 28:
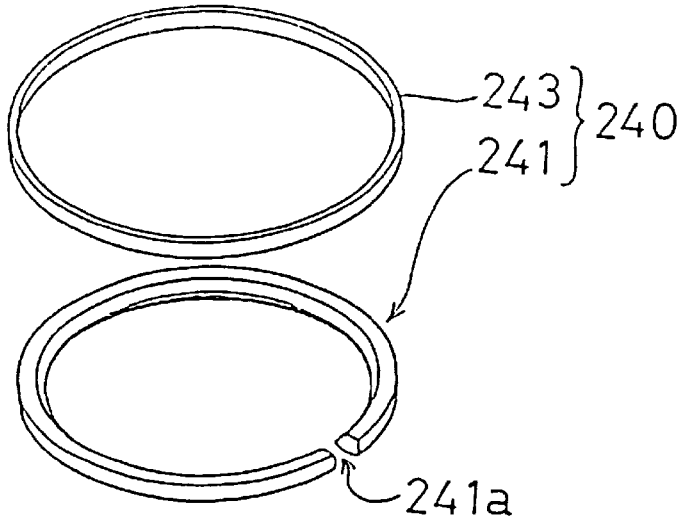

FIGS. 20 to 25 show modifications of the rotary ring 130 or the brake ring 140. FIGS. 20 and 21 show a rotary ring 130A. FIGS. 22 and 23 show a brake ring 148B. FIGS. 24 and 25 show a brake ring 148C. FIGS. 26 to 28 show a slide ring 240 as a modification of the slide ring 140.

The rotary ring 130A shown in FIG. 20 has no member corresponding to the brake ring 145 described above. Instead, a plurality of brake elements 148A are directly mounted on the rotary ring 130A.

Specifically, the rotary ring 130A has its outer periphery lower portion formed with an annular recess 147A as brake element assembling recess, and brake elements 148A (FIG. 21) are each movably mounted by a pin 148A*b* in the recess 147A.

A centrifugal force generated with the rotation of the rotary ring 130A causes each brake element 148A to be projected to bring a contact portion 148A*a* thereof into contact with the inner surface 123 of the stationary ring 120, thus generating a frictional force.

The brake ring 146B shown in FIG. 22, like the brake ring 146 shown in FIG. 18, is assembled on the rotary ring 130.

The body 146B*b* of the brake ring 146B has a lower outer flange portion 146B*a* and a plurality of recesses 147B communicating with the flange portion 146B*a*. Each brake element 148B (FIG. 23) has a fist-like stem 148B*b* which is rotatably fitted in each recess 147B. Each brake element 148B thus can be advanced and retreated relative to the brake ring 146B.

Rotation of the rotary ring 130 causes each brake element 148B to be advanced so that the contact portion 148B*a* thereof is brought into contact with the inner surface 123 of the stationary ring 130 to generate a frictional force.

The brake ring 146C shown in FIG. 24 has a lower outer flange portion 146C*a* which in turn has a plurality of recesses 147C of substantially T-shaped configuration in top view. The recess 147C has a pair of stopper portions 147C*a*, and it also has a play space l47C*b* extending in the radial direction of the brake ring 146C.

Each brake element 148C (FIG. 25) corresponds in shape to the recess 147C, that is, it is substantially T-shaped in top view, and its stem has a pair of stopper portions 148C*b*.

Each brake element 148C is fitted in each recess 147C for advancement and retreat through the play space 147C*b*. The brake element 148C is retained against detachment by the stopper portions 147C*a* of the recess 147C and the stopper portions 148C*b* of the brake element 148C.

Rotation of the rotary ring 130 causes each brake element 148C to be advanced to bring the contact portion 148C*a* thereof into contact with the inner surface 123 of the rotary ring 130, thus generating a frictional force.

The spinning ring 210 shown in FIG. 26 features a slide ring 240 (FIGS. 27 and 28).

The slide ring 240 comprises a main ring 241 and a reinforcement ring 243. The main ring 241 has substantially the same construction as the slide ring 140 (FIG. 17) described before, and has a smaller outer diameter than the reinforcement ring 243. The main ring 241, like the slide rings 40 and 140 shown in FIGS. 6 and 17, respectively, are made of engineering plastic material, elastomer or metal which is elastic, heat-resistant and wear-resistant as well having very low coefficient of friction, and has a cut section 241*a*.

The reinforcement ring 243 has a simple ring-like form and is made of an engineering plastic material which is particularly excellent in mechanical strength. The main ring 241 and the reinforcement ring 243 have different vibration attenuating characteristics.

The slide ring 240 is obtained by loosely fitting the reinforcement ring 243 on the main ring 241.

The slide ring 240 has the following peculiar functions and effects.

The slide ring 240 (140) is rotated with the rotation of the rotary ring 130 (FIGS. 28 and 16). The slide ring 140 (FIG. 17) noted above can be expanded by the centrifugal force generated with the rotation of the rotary ring 130, so that it may be in forced contact with the rotary ring 120 (i.e., the slide ring outer portion receiving recess 121). As a result, the frictional force (or sliding resistance) between the stationary ring 120 and the slide ring 140 may be increased to prevent smooth rotation of the rotary ring 130. The main ring 241 of the slide ring 240 (FIG. 8), however, is not expanded beyond a predetermined diameter by virtue of the reinforcement ring 243. This means that the slide ring 240 itself is not expanded beyond a predetermined diameter, so that it is prevented from being in forced contact with the stationary ring 120 (i.e., the slide ring outer portion receiving recess 121). Thus, smooth rotation of the rotary ring 130 is ensured.

Besides, the different vibration attenuating characteristics of the main ring 241 and the reinforcement ring 243 permit more effective attenuation of vibrations.

Third Embodiment

Figure 29:
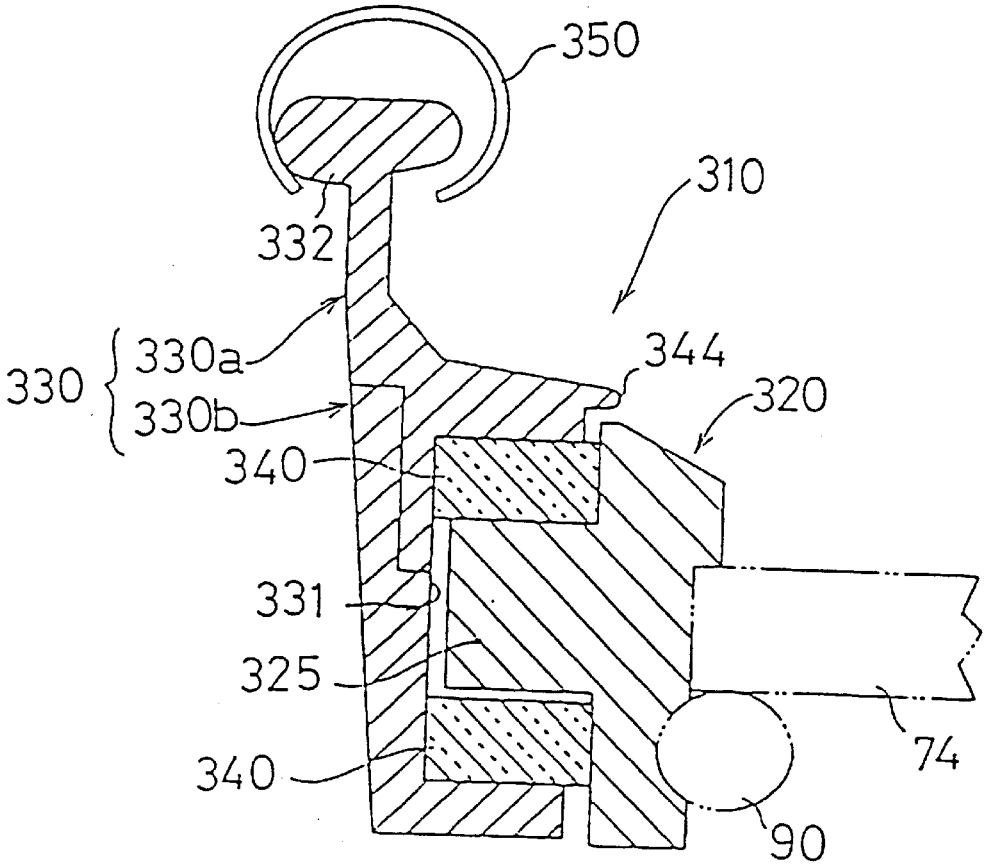
FIG. 29 is a fragmentary sectional view (corresponding FIGS. 4 and 16) for describing a spinning ring 310 according to a third embodiment of the invention.

A spinning ring 310 according to a third embodiment of the invention will now be described with reference to FIG. 29. The differences from the spinning ring 10 of the first embodiment will be mainly described.

The spinning ring 310 again comprises a stationary ring 320, a rotary ring 330 and a traveler 350. The traveler 350 is mounted on a flange portion 332 of the rotary ring 330 for revolution relative thereto.

The rotary ring 330 comprises a first part 330*a* and a second part 330*b*, these parts 330*a* and 330*b* being separate members. The rotor ring 330 (i.e., the first part 330*a* thereof) has a dust-proof flange portion 344.

The stationary ring 320 has an inner ring-like ridge 325 formed on substantially a central portion of its inner peripheral surface in the height direction. Slide rings 340 are each disposed on and under the ring-like ridge 325 and between the stationary ring 320 and the rotary ring 330. The slide rings 340, like the slide ring 40 (FIG. 4) noted above, are capable of sliding relative to both the stationary ring 320 and the rotary ring 330.

With this spinning ring 310, the following peculiar functions and effects are obtainable.

With the revolution of the traveler 350 generating tension in the yarn T (i.e., the spun yarn T2), the rotary ring 330 tends to undergo fine precession (see the spinning ring 10 in FIG. 4). In this spinning ring 310, however, such precession is prevented owing to the two slide rings 340 which the provided in a predetermined spacing in the central axial direction (i.e., in the vertical direction) of the stationary ring 320 and the rotary ring 330. Accurate rotation of the rotary ring 330 about the central axis thereof thus can be ensured.

Without precession of the rotary ring 330, it is possible to ensure uniform and smooth high speed revolution of the traveler 350. In addition, without precession of the rotary ring 330, the friction (i.e., rotational resistance) with respect to the stationary ring 320 is not increased, so that it is possible to ensure smooth high speed rotation of the rotary ring 330.

While in the spinning ring 10 (FIG. 4), the stationary ring 20 and the rotary ring 30 provide shearing forces to the slide ring 40, in the present spinning ring 310, the stationary ring 320 and the rotary ring 330 provide compressive forces. The slide ring (10, 310, ect.) is stronger in mechanical strength with respect to compressive force than with respect to shearing forces. Thus, the durability of the slide ring 340 can be improved.

Modification of Third Embodiment

Figure 30:
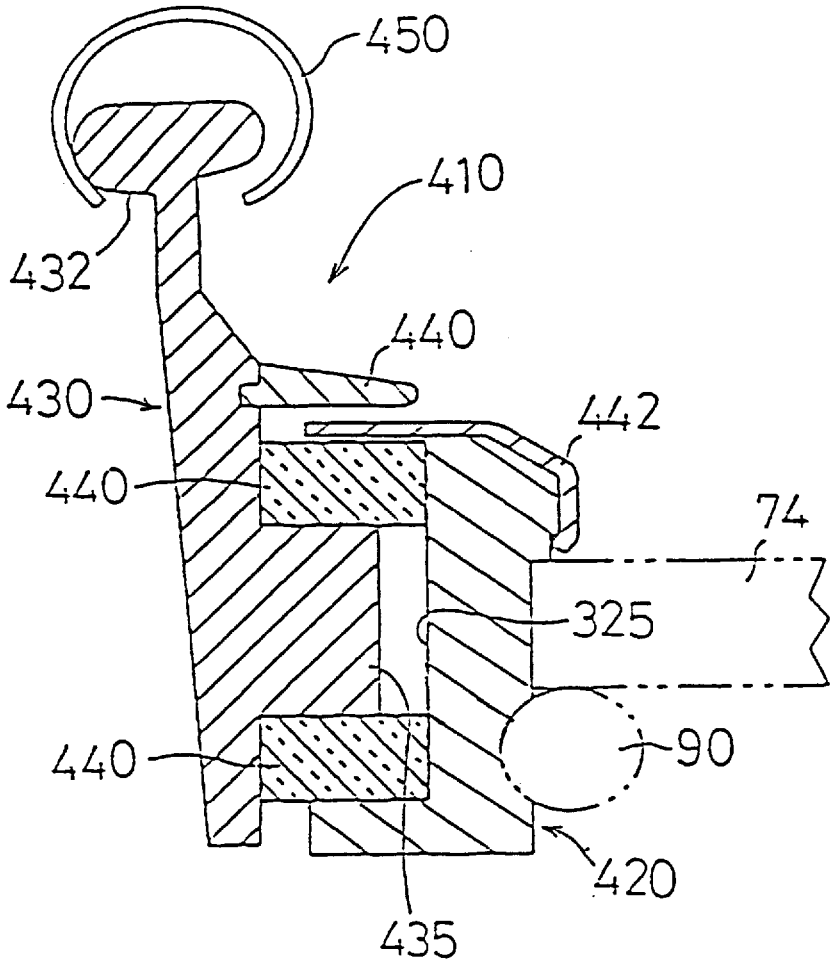
FIG. 30 is a fragmentary sectional view for describing the spinning ring 410 as a modification of the spinning ring 310 of the third embodiment.

A modification of the spinning ring 310 of the third embodiment, i.e., a spinning ring 410, will now be described with reference to FIG. 30.

The spinning ring 410 again comprises a stationary ring 420, a rotary ring 430 and a traveler 450. The traveler 450 is mounted for revolution on a flange portion 432 of the rotary ring 430.

The rotary ring 430 has a ring-like ridge 435 formed on its outer peripheral surface. Slide rings 440 are each disposed on and under the ring-like ridge 435 and between the stationary ring 420 and the rotary ring 430. The slide rings 440, like the slide ring 40 (FIG. 4) noted above, are capable of sliding relative to both the stationary ring 420 and the rotary ring 430.

The rotary ring 430 is provided with a dust-proof cover 440, and the stationary ring 420 is provided with a liner cover 442.

Again in this spinning ring 410, like the previous spinning ring 310 (FIG. 29), precession of the rotary ring 430 can be prevented.

In addition, in the preceding spinning ring 310 (FIG. 29), the rotary ring 330 comprises the first part 330*a* and the second part 330*b* which are separated from each other for assembling the slide rings 340 and which are subsequently coupled together. The present spinning ring 410 has an advantage that the slide rings 440 can be assembled on the rotary ring 430 which is a one-piece member.

I claim:

1. A spinning ring for winding a yarn fed from a yarn feeder on a bobbin, comprising:

a stationary ring mounted on a base member;

a rotary ring disposed inside and concentrically with the stationary ring for rotation about the central axis thereof, the bobbin being disposed inside and concentrically with the rotary ring for rotation about the central axis thereof;

a traveler disposed on the rotary ring for revolution in the circumferential direction of the rotary ring to guide the yarn feed from the yarn feeder with respect to the bobbin; and an air brake section provided on the rotary ring and serving to apply a brake force to the rotary ring during the rotation of the rotary ring, the brake force being produced by a frictional force between the air brake section and the air around the rotary ring;

the air brake section being positioned inside of said stationary ring and comprising a plurality of blades extending in the radial direction of the rotary ring.

2. A spinning ring for winding a yarn fed from a yarn feeder on a bobbin, comprising:

a stationary ring mounted on a base member;

a rotary ring disposed inside and concentrically with the stationary ring for rotation about the central axis thereof, the bobbin being disposed inside and concentrically with the rotary ring for rotation about the central axis thereof;

a traveler disposed on the rotary ring for revolution in the circumferential direction of the rotary ring to guide the yarn fed from the yarn feeder with respect to the bobbin; and a brake section provided on the rotary ring serving to apply a brake force to the rotary ring during the rotation of the rotary ring, the brake section comprising a plurality of brake elements that advance and retreat in a plane parallel to the radial plane of the rotary ring, the brake elements being advanced by centrifugal forces generated with the rotation of the rotary ring, the advanced brake elements being brought into contact with the stationary ring.

3. A spinning ring for winding a yarn fed from a yarn feeder on a bobbin, comprising:

a stationary ring mounted on a base member;

a rotary ring disposed inside and concentrically with the stationary ring for rotation about the central axis thereof, the bobbin being disposed inside and concentrically with the rotary ring for rotation about the central axis thereof;

a traveler disposed on the rotary ring for revolution in the circumferential direction of the rotary ring to guide the yarn fed from the yarn feeder with respect to the bobbin; and an air brake section provided on the rotary ring and serving to apply a brake force to the rotary ring during the rotation of the rotary ring, the brake force being produced by a frictional force between the air brake section and the air around the rotary ring;

wherein when the bobbin is rotated substantially at normal operating speed, the speed of the traveler relative to the rotary ring is substantially zero, so that the traveler and the rotary ring are rotated substantially in unison with each other relative to the stationary ring.

4. The spinning ring according to claim 3 wherein the air brake section comprises a plurality of blades extending in the radial direction of the rotary ring.

* * * * *